US008061925B2

(12) United States Patent
Volkmann

(10) Patent No.: US 8,061,925 B2
(45) Date of Patent: Nov. 22, 2011

(54) VEHICLE RESTRAINING SYSTEM FOR LIMITING ROADWAYS

(75) Inventor: Vanessa Volkmann, Montabaur (DE)

(73) Assignee: Volkmann & Rossbach GmbH & Co. KG, Montabaur (DE)

( * ) Notice: Subject to any disclaimer, the term of this patent is extended or adjusted under 35 U.S.C. 154(b) by 252 days.

(21) Appl. No.: 12/088,192

(22) PCT Filed: Sep. 26, 2005

(86) PCT No.: PCT/EP2005/010390

§ 371 (c)(1),
(2), (4) Date: Jul. 9, 2008

(87) PCT Pub. No.: WO2007/036239

PCT Pub. Date: Apr. 5, 2007

(65) Prior Publication Data

US 2009/0035060 A1 Feb. 5, 2009

(51) Int. Cl.
*E01F 15/00* (2006.01)

(52) U.S. Cl. ..... 404/6; 404/9; 256/13.1

(58) Field of Classification Search ..... 404/6, 9–11; 256/13.1

See application file for complete search history.

(56) References Cited

U.S. PATENT DOCUMENTS

| | | | | |
|---|---|---|---|---|
| 817,282 | A * | 4/1906 | Stewart | 256/35 |
| 3,678,815 | A * | 7/1972 | Younker | 14/73 |
| 4,348,133 | A * | 9/1982 | Trent et al. | 404/6 |
| 4,496,264 | A * | 1/1985 | Casey | 404/6 |
| 4,681,302 | A * | 7/1987 | Thompson | 256/13.1 |
| 4,954,009 | A * | 9/1990 | Kellison | 404/6 |
| 5,009,542 | A * | 4/1991 | Hardin et al. | 404/6 |
| 5,145,278 | A * | 9/1992 | Lohrmann | 404/6 |
| 5,211,503 | A | 5/1993 | Quittner | |
| 5,217,318 | A * | 6/1993 | Peppel | 404/6 |

(Continued)

FOREIGN PATENT DOCUMENTS

DE 3816528 * 3/1989

(Continued)

OTHER PUBLICATIONS

International Search Report of PCT/EP2005/010390, date of mailing May 26, 2006.

*Primary Examiner* — Raymond Addie
(74) *Attorney, Agent, or Firm* — Westerman, Hattori, Daniels & Adrian, LLP

(57) ABSTRACT

The invention relates to a vehicle restraining system for limiting roadways comprising a base beam extending along the longitudinal axis, which overlies a U-shaped bottom and, in the plane view of an orthogonal cross-section along the longitudinal axis, reduces from the U-shaped bottom upwardly and a leading profile, which extends along the longitudinal axis, is placed above the base beam and is fixed thereto. According to said invention said base beam and the guiding profile are connected to each other by means of an intermediate connecting area, which is closed at least on one side and extends, in a substantially vertical direction, from the top end of the base beam upwardly towards the guiding profile, wherein the base beam, the connecting area and the guiding profile form a wall element and, in the plane view of an orthogonal cross-section along the longitudinal axis, said guiding profile extends with respect to the connecting area towards the road way, at least locally.

17 Claims, 4 Drawing Sheets

U.S. PATENT DOCUMENTS

| | | | | |
|---|---|---|---|---|
| 5,425,594 | A * | 6/1995 | Krage et al. | 404/6 |
| 5,498,101 | A * | 3/1996 | Braverman | 404/6 |
| 5,551,796 | A * | 9/1996 | Anderson et al. | 404/6 |
| 6,439,802 | B1 * | 8/2002 | Duckett | 404/6 |
| 6,669,402 | B1 * | 12/2003 | Davis et al. | 404/6 |
| 6,782,624 | B2 * | 8/2004 | Marsh et al. | 29/897.32 |
| 7,128,208 | B2 * | 10/2006 | Hull | 206/363 |
| 2006/0245826 | A1 * | 11/2006 | Shaw et al. | 404/6 |

FOREIGN PATENT DOCUMENTS

| | | | |
|---|---|---|---|
| DE | 3 827 030 | A1 | 4/1989 |
| DE | 102 29 051 | C1 | 11/2003 |
| EP | 0 641 892 | A | 3/1995 |
| EP | 0 761 889 | A1 | 3/1997 |
| EP | 1 418 274 | A1 | 5/2004 |
| FR | 2 613 739 | A | 10/1988 |
| GB | 821 894 | A | 10/1959 |

* cited by examiner

VEHICLE RESTRAINING SYSTEM FOR LIMITING ROADWAYS

The present invention relates to a vehicle restraining system for limiting roadways having a base barrier running along a longitudinal axis, which rests on an under-ground and which tapers from the underground in upward direction, when viewed in a section orthogonal to the longitudinal axis, and having a guiding profile running along the longitudinal axis, which is arranged above the base barrier and connected thereto.

In order to safeguard roadways, vehicle restraining systems are provided laterally to the roadways. Besides constructions made of concrete, as for example the so-called "New Jersey Profile" known in the art, in particular guard rail arrangements made of steel are preferably used.

Vehicle restraining systems can be categorized in dependence on their respective structure into different safety categories. For such a classification, parameters are used, which are determined in experiments. One of these parameters is the so-called "restraining factor", which provides information about the capability of restraining and deflecting a colliding -vehicle by means of the respective vehicle restraining system. A further parameter is the so-called "operation range", which is determined by the dynamic transverse shifting and the actual structure of the vehicle restraining system. Finally, a parameter called "collision intensity factor" is used for an estimation of the impact to the vehicle occupants during a collision of the vehicle with the vehicle restraining system and the seriousness of injuries to be expected.

For cost reasons, it is nowadays preferred to provide vehicle restraining systems which are made of steel as a construction kit and, thereby, to provide the possibility to use modularly different components from this construction kit, dependent on the respective case of application and dependent on the respective requirements to be fulfilled. Such vehicle restraining systems are for example known from the closest prior art according to DE 38 27 030 A1, as well as from the documents EP 0 761 889 A1, DE 102 29 051 C1 or EP 1 418 274 B1. In these vehicle restraining systems, the guiding profile is coupled by means of post elements to a base barrier or directly to the underground.

When using conventional systems, it is difficult to achieve a high restraining factor together with a low collision intensity at the same time. This means in other words that those vehicle restraining systems known from the prior art, which have a high restraining capability, i.e. which are capable to restrain also heavy vehicles having a high collision velocity and a relatively large collision angle, lead due to a relatively small deformation capability to a relatively high collision intensity, whereby they do not provide sufficient protection for vehicle occupants during a collision. This problem particularly becomes due when using constructions made of concrete, which is the case for the above mentioned New Jersey profile. A collision of a small vehicle with a vehicle restraining system formed as a concrete construction is not sufficiently cushioned. Instead, in such collision situations, the small vehicle regularly ascends the concrete construction and overturns. On the other hand, constructions made of concrete offer the benefit of a substantially closed outer profile. This leads to a situation, even when the collision angle is large, that a colliding vehicle, particularly a heavy vehicle, does not stick to the restraining system but slides along the same. In contrary, such an unwanted sticking of the colliding vehicle with the vehicle restraining system easily occurs with arrangements according to the above mentioned documents of the prior art, for example as the vehicle engages a freely exposed post element and is hindered thereby to a further slide off.

It is the object of the invention to provide a vehicle restraining system as outlined above, which has a small collision intensity and which at the same time reduces the risk of an uncontrolled ascending of light vehicles in a collision situation and which also prevents that a colliding heavier vehicle gets stuck thereto.

This object is solved by a vehicle restraining system according to the introductory part, which provides that the base barrier and the guiding profile are connected to one another by means of a connecting region, which is closed at least at one side and which extends from the upper end of the base barrier substantially in vertical direction aboard leading to the guiding profile, whereby the base barrier, the connection region and the guiding profile form a wall element, and that the guiding profile, when viewed in a section orthogonal to the longitudinal axis, projects with respect to the connection region at least in sections towards the roadway.

A vehicle restraining system according to the invention, which is formed by such wall elements, has the benefit, that no freely exposed post elements are provided, which can interact with a colliding vehicle such that the latter engages with the vehicle restraining system and is thereby prevented from sliding off along the latter. It rather forms a substantially closed wall facing to the roadway along which the colliding vehicle can slide off, even if the collision angle is large. The vehicle restraining system according to the invention therefore behaves in this respect with the same benefit as a construction made of concrete. This particularly applies for heavy vehicles. In order to prevent an unwanted ascending of light vehicles, for example small vehicles, the guiding profile according to the invention is arranged such that it projects with respect to the connection region in the direction towards the roadway. Although a colliding small vehicle may ascend due to the tapering shape of the base barrier in upward direction when colliding with this arrangement, however, the small vehicle impinges during ascending on the projecting guide profile, whereby a kind of a counter-impetus is effected, which prevents or at least reduces further ascending. As a result, the vehicle is redirected back to the roadway and an overturning of the vehicle is prevented.

It shall be understood that the vehicle restraining system according to the invention is formed as a construction made of steel and therefore has a sufficient capability of being deformed, similar as discussed in the introductory part with respect to the prior art steel constructions. Thereby, in regard to the achievable collision intensity factor, it has substantial benefits compared to constructions made of concrete, as the collision energy can be better absorbed by the deformation.

According to one embodiment of the invention, it is provided that the wall element, when viewed in a section orthogonal to the longitudinal axis, has a substantially continuous contour which is open to the underground. If necessary, also the region faced to the underground can be closed. Beneficially, the invention can further provide that the wall element is formed symmetrically with respect to a vertical axis substantially orthogonal with regard to the longitudinal axis and to the underground, when viewed in a section orthogonal to the longitudinal axis. Such a vehicle restraining system can be arranged also on a median strip, which separates two roadways with opposing driving directions from one another.

In order to stabilize the vehicle restraining system according to the invention, it can be provided that the wall element has an insertion piece on its longitudinal ends, which is inserted into the wall element. In this respect, it is possible according to the invention that the insertion piece is at least partially welded to the inner surface of the wall element. Moreover, it can be provided in order to stiffen the vehicle restraining system according to the invention that the wall element is provided with stiffening rips extending in the direction of the longitudinal axis. These stiffening rips may extend in vertical or in horizontal direction transversally to the longitudinal axis.

In order to limit longer roadway distances, according to the present invention it is possible, as per se usual, to assemble the vehicle restraining system wall element by wall element, wherein two adjacent wall elements can be coupled by connecting two insertion pieces facing one another.

According to the invention, the vehicle restraining system may be used both on linear roadways as well as on curved roadway courses. In the latter case, it is necessary to angle separate wall elements with respect to one another. This can be achieved by means of mitered portions. When having larger curved radiuses, it is sufficient to position separate wall elements in their connecting region with a certain play with regard to one another. To this purpose, it is possible according to the invention, that the wall elements are elastically screwed to one another by means of a screw connection. In this respect, it is possible that the screw connection has a resilient plastic bushing, for example made of polyurethane, or/and a Belleville spring arrangement. In order to allow an adaptation to different curved courses, according to the present invention, wall elements having different lengths can be provided.

In order to facilitate the assembly, one embodiment of the invention provides that an angle arrangement is mounted at at least one of the insertion pieces arranged at the end of one of the wall elements, which when assembling the vehicle restraining system receives an insertion piece arranged at the end of a further wall element in a positioning manner. According to one constructive variant, it is possible in this respect, that the angle arrangement has a ground plate and two supporting angles arranged in a distance to one another, wherein the distance between two surfaces of the supporting angles facing to one another is larger than the double wall thickness of an insertion piece. One of the supporting angles can be fixed to the insertion piece, for example by screwing, whereas the other insertion piece can be moved during the assembly between the insertion piece and the further supporting angle. The angle arrangement therefore acts as a mounting bracket, which holds the two adjacent wall elements with respect to one another.

Furthermore, in order to facilitate the assembly, in particular in order to reduce the effort for a correct positioning of two wall elements adjacent to one another, it can be provided, that a positioning wedge arrangement is provided at least at one insertion piece arranged at the end of the wall elements, wherein the positioning wedge interacts during the assembly of the vehicle restraining system with a corresponding wedge opening in an insertion piece arranged at the end of a further wall element in a positioning manner. Even if the wedge opening and the positioning wedge are positioned with a certain play with respect to one another, the positioning wedge arrangement provides a sufficiently satisfying positioning of the adjacent wall elements to be connected to one another. In this respect, it is further possible, that a positioning wedge extends in the direction of the longitudinal axis and is faced, preferably abuts, with its frontal surface to an insertion piece associated thereto, and which has at its opposing frontal surface a holding plate arranged substantially in orthogonal direction with regard to the longitudinal axis. Also this arrangement functions, besides the positioning effect, similar to a bracket, which connects two adjacent wall elements by means of their insertion pieces facing one another.

It is to be understood that the vehicle restraining system according to the invention is to be supported robustly on the underground. In order to achieve the latter, a further embodiment of the invention provides that plurality of transversal skids is associated to each wall element, which run transversally with regard to the longitudinal axis and by means of which transversal skids the respective wall elements of the vehicle restraining system rest on the underground. Experiments have revealed that in many applications, additional measures are necessary in order to mount the vehicle restraining system on the underground such that it maintains its position. This can be achieved, for example, by providing the surface of the transversal skids contacting the underground with a certain friction increasing surface structure, for example by providing nobs, ribs, pins or the like welded thereto. Alternatively the invention may provide that the transversal skids can be coupled with a friction cover increasing the friction and can rest therewith on the underground. The friction cover may be made from a rubber material and may be coupled, for example by means of mushroom head connections, to the respective transversal skids.

Like conventional vehicle restraining systems, the solution according to the invention can also be fixed to the underground. This is for example possible by fixing the transversal skids to the underground, preferably by means of an elongated hole extending transversally to the longitudinal axis. In this respect, the transversal skids can be screwed to the underground. During a certain collision the elongated hole allows, dependent on the applied transversal force, a locally limited dynamic transversal shifting of one or more wall elements, whereby the collision energy can be absorbed and the collision intensity can be reduced.

A further development of the present invention provides that in each of the wall elements engagement openings are provided facilitating the assembly. During the assembly, the assembling staff may grip into these engagement openings, for example in order to mount fixing screws or the like. Moreover, these engagement openings may serve during the manufacturing for applying internally arranged welding seams.

In respect to a facilitated manufacturing, a further development of the invention provides that the wall element is composed of sheet portions, which are preferably edge bended. These sheets portions can be connected, particularly welded, to respective insertion pieces.

It shall be understood that the vehicle restraining system according to the invention can be designed on demand with different dimensions. According to a further embodiment of the invention, it can be provided for example, that the width of the guiding profile, when viewed in a section orthogonal to the longitudinal axis, is larger than 1.3, preferably larger than 1.5, more preferably larger than 1.7 times the width of the connecting region.

In the following, embodiments of the invention are discussed based on the attached figures, wherein FIG. 1 shows a front view, orthogonally to the longitudinal axis, of a wall element of the vehicle restraining system according to the invention;

Figures 1, 4, 5, 6, 7:
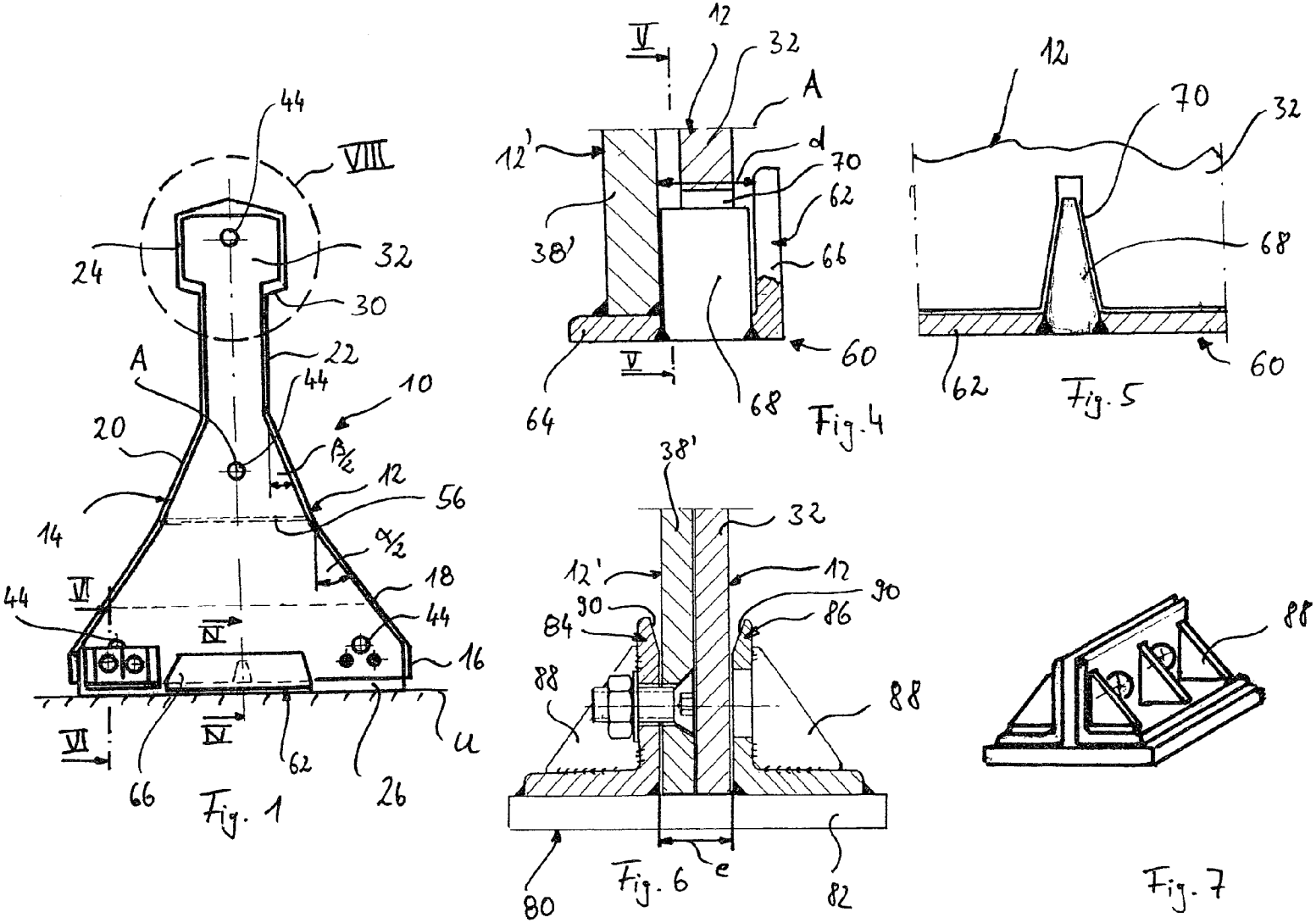
FIG. 4 shows a sectional view according to section line IV-IV of FIG. 1.
FIG. 5 shows a sectional view according to section line V-V of FIG. 1.
FIG. 6 shows a sectional view according to section line VI-VI of FIG. 1.
FIG. 7 shows a perspective detailed view of the angle arrangement.

In the figures, a vehicle restraining system according to the invention extending along a longitudinal axis A is generally depicted with reference number 10. The vehicle retaining system 10 according to the invention is composed of a plurality of wall elements 12 attached to one another. One single wall element 12 is composed of a base barrier of 14 with a broad base 16 and a with two portions 18 and 20 tapering in upward direction, a connecting region 22 and a guiding profile 24 formed like a head, when viewed in a cross sectional view. This structure of the wall element 12 is formed by a substantially continuous "outer skin" made of steel. The wall element 12 rests via transversal skids 26 on the underground U, for example an asphaltic street.

The two portions 18 and 20 tapering upwardly of the base barrier 14 have different opening angles α and β. The portion 18 has an opening angle a of about 70°, whereas the portion 20 has an opening angle β of about 45°.

Figure 8:
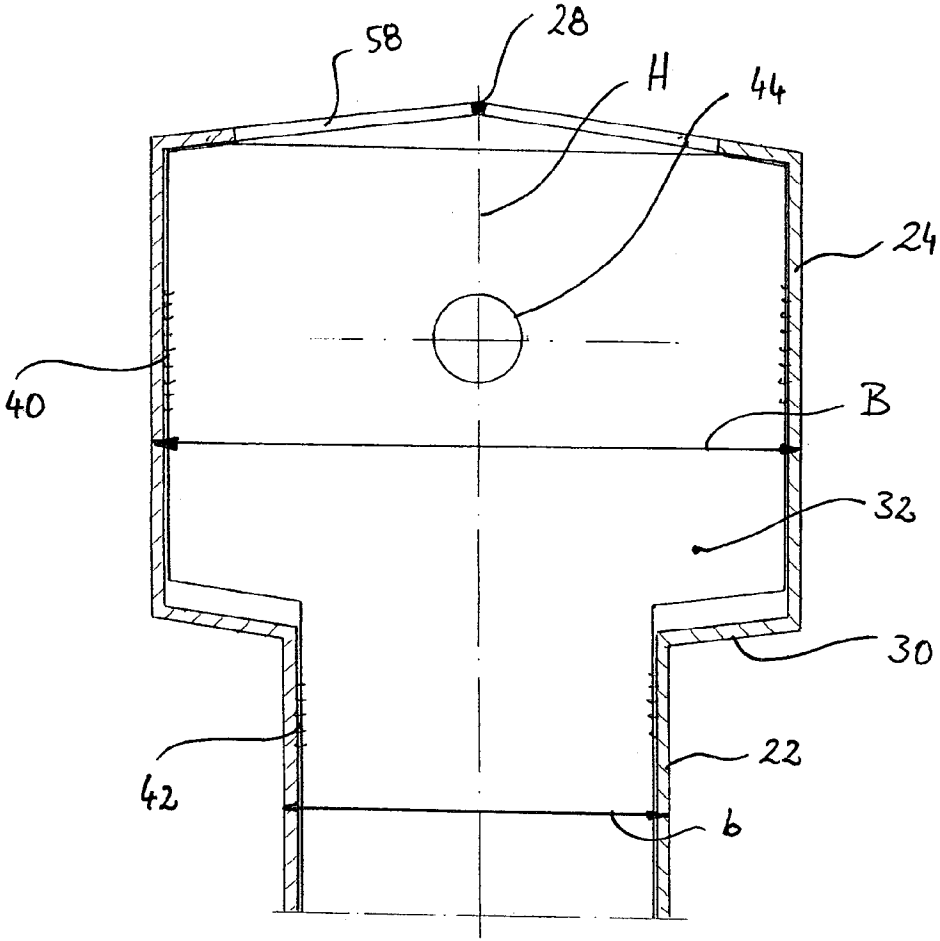
FIG. 8 shows an enlarged detailed view of the area VIII shown in FIG. 1.

The connecting region 22 extends starting from the base barrier 14 substantially in vertical upward direction. It has a substantially constant width b. At the upper end of the connecting region 22 the guiding profile 24 follows, which—as apparent from the sectional views according to FIGS. 1 and 8—has a width B, which is substantially larger than the width b of the connecting region 22. In the shown embodiment, the ratio b: B amounts to about 1:1.7. Thereby a shoulder 30 is formed starting from the connecting region 22 and extending transversally to the longitudinal axis A. Moreover, it is obvious from the figures, that the guiding profile 24 is formed roof-like at its upper side and has an apex 28. FIGS. 1 and 8 show that the outer contour of each wall element 12 is substantially symmetrical with regard to the vertical axis H.

Within the outer skin of each wall element 12, insertion pieces 32, 34, 36, 38 are inserted in regular intervals, which are welded by means of a plurality of welding seams 40, 42 to the outer skin at its inner surface. Except for gaps provided due to manufacturing, the outer contour of the insertion pieces 32, 34, 36, 38 substantially corresponds to the contour of the inner surface of the outer skin (when viewed in a front view orthogonal to the longitudinal axis). One can see that the insertion pieces 32 and 38 are mounted at the end and substantially flushing with the wall element 12. At least the insertion pieces 32 and 38 provided at the end have connection bores 44 or 46. Into these connection bores 44 or 46 connection screws 48 are insertable, by means of which two adjacent insertion pieces 32 and 38' of two adjacent wall elements 12 and 12' can be screwed to one another. This is shown in the embodiment according to a FIG. 9. In order to provide a predetermined play s which allows a certain flexibility when connecting two adjacent wall elements 12 and 12', the connection bore 46 is formed with a slightly larger diameter and receives a plastic tube 50 formed from PUR (Polyurethane). This is flexible such that the two adjacent wall elements 12 and 12' can be angled with regard to one another to a certain degree. Thereby the vehicle restraining system 10 according to the invention composed by a plurality of adjacently arranged wall elements 12 and 12' can be adapted to a curvature of a roadway curve.

Figure 9:
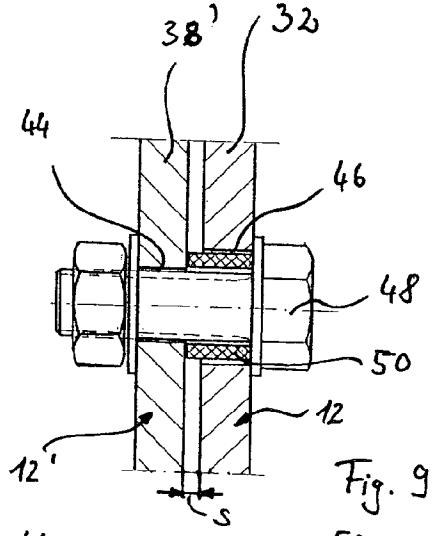
FIG. 9 shows a cross-sectional view of a possible screw connection of two insertion pieces.
Figure 10:
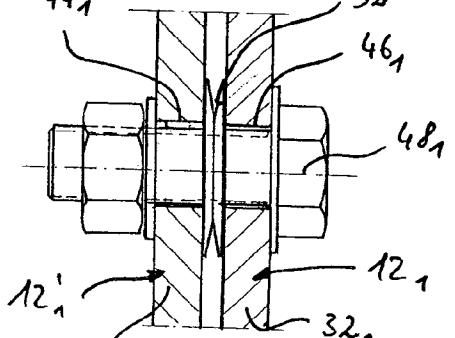
FIG. 10 shows a cross-sectional view of an alternative screw connection of two insertion pieces and FIG. 11 is a perspective view showing a transversal skid together with a cover as single parts.

FIG. 10 shows an alternative to the fixation according to FIG. 9. Instead of using a plastic queue 50, in this embodiment the flexibility is achieved by means of a Belleville washer package 52.

Furthermore, as shown in the figures, a plurality of locally limited engagement openings 58 is provided in the outer skin of the steel sheet, which provide access to the interior of each wall element 12 or 12' and which are beneficial during the manufacturing and the assembly of the vehicle restraining system 10 according to a the invention.

FIGS. 4 to 7 show different measures, which substantially facilitate the assembly of the vehicle restraining system 10 according to the invention and which increase its stability. FIGS. 4 and 5 show a wedge arrangement 60. This provides an angle element 62 which is welded with its horizontal portion 64 to the underside of an insertion piece 38' arranged at the end of a wall element 12'. The vertical portion 66 of the angle element 62 extends in a distance d to the surface of the insertion piece 38'. A positioning wedge 68 is arranged between the insertion piece 38' and the vertical portion 66, which positioning wedge 68 is fixedly welded to the angle element 62. The positioning wedge 68 tapers in upward direction, as shown in FIG. 5. In the central area of the insertion piece 32 of the adjacent wall element 12 a corresponding wedge-like wedge opening 70 is provided, the geometry of which substantially corresponds to the outer contour of the positioning wedge 68.

When assembling the vehicle restraining system 10 according to the invention, two wall elements 12 and 12', which are to be connected to one another, are positioned with respect to one another such that the wall element 12 with its positioning opening 70 is moved upon the positioning wedge 68 of the wall element 12', wherein the two wall elements 12 and 12' are positioned automatically with respect to one another. The vertical portion 66 of the angle element 62 prevents during the assembly as well as in the assembled state that the two wall elements 12 and 12' are uncoupled from one another, if a high transversal force is applied, eventually during a collision.

FIGS. 6 and 7 show a further assembly support, which additionally provides further stability to the vehicle restraining system 10 according to the invention in case of a collision. In this respect an angle arrangement 18 is provided, which is composed of a ground plate 82 and two supporting angles 84 and 86 welded thereto. The two supporting angles 84 and 86 are stabilized by means of strengthening sheets 88 welded thereto. These supporting angles 84 and 86 are arranged in a distance e to one another which is dimensioned such that the two insertion pieces 12 and 12' can be inserted therebetween with a certain play. For facilitating the latter the tool supporting angles 84 and 86 are provided with insertion chamfers 90. In the embodiment shown, the angle arrangement 80 is screwed to the insertion piece 38' provided at the end. The insertion piece 32 of the adjacent wall element 12 is inserted into the remaining gap between the insertion piece 38' and the support angle 86. The angle arrangement 80 thus functions as a bracket, which, in a situation when stress is applied, holds the two insertion pieces 32 and 38' together and which therefore holds the two adjacent wall elements 12 and 12' together.

Figure 11:
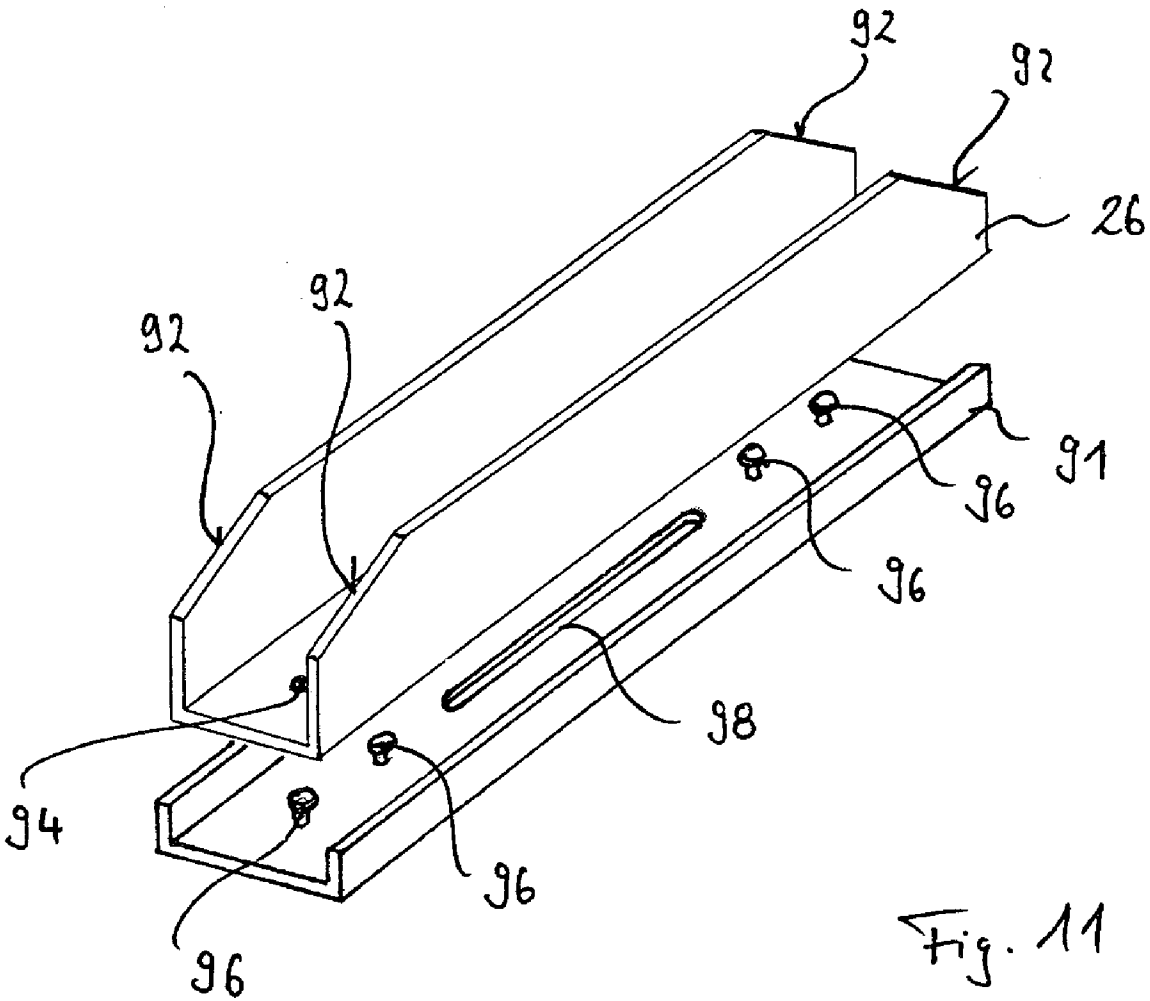

FIG. 11 shows a transversal skid 26 and a friction cover 91 associated thereto in an exploded view. It is shown that the transversal skid is provided at its ends with chamfers 22 which are adapted to the outer contour of the tapering portion 18. The transversal skid is provided with a series of holes 94 as well as with an elongated hole in its central portion, which is not shown in detail in FIG. 11. The friction cover 91 has a U-shape and is formed from rubber material with a high friction coefficient. It is dimensioned such that it can be mounted from below to the transversal skid 26 and that it encompasses the transversal skid 26 with its two parallel U-journals. The friction cover 91 is integrally provided with mushroom head-like engaging elements 96, which can be engaged with the holes 94 of the transversal skid 26, in order to fix the friction cover 91 to the transversal skid 26. Moreover, the friction cover 91 is provided with an elongated hole 98 corresponding to the transversal skid 26, which has the same dimensions as the elongated hole of the transversal skid 26. By means of these elongated holes the transversal skid 26 can be screwed together with the friction cover 91 to the underground U (see FIG. 1). The elongated holes have the purpose to permit a transversal shift of certain wall elements 12 of the vehicle restraining system 10 according to the invention in transversal direction with respect to the underground, for example in a collision situation, in order to absorb collision energy.

Figure 2:
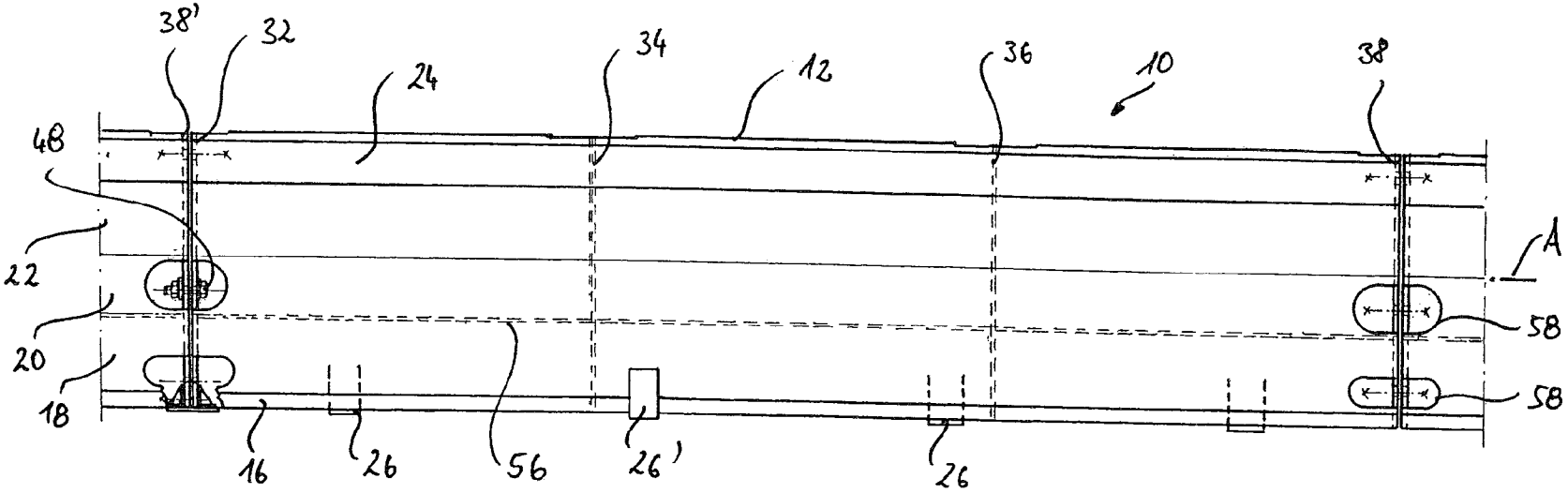
FIG. 2 shows a side view of the vehicle restraining system according to the invention.

It is to be understood that the wall elements 12 can be provided with different lengths, preferably in dimensions between two to eight meters. Thereby it is possible that the vehicle restraining system 10 according to the invention can be adapted to arbitrary roadway courses. In case of a smaller radius of curvature, for example shorter wall elements are used. On the other hand, in case of a larger radius of curvature and rather linear roadway courses, longer wall elements are used. Moreover, the distances between certain insertion pieces 32, 34, 36, 38 as well as the number of insertion pieces per wall element can be varied on demand. If necessary, it is also possible to insert longitudinal stiffening sheets, as shown in FIG. 1 and 2 with reference number 56. These sheets 56 additionally increase the stability and the strength of single wall elements.

Figure 3:
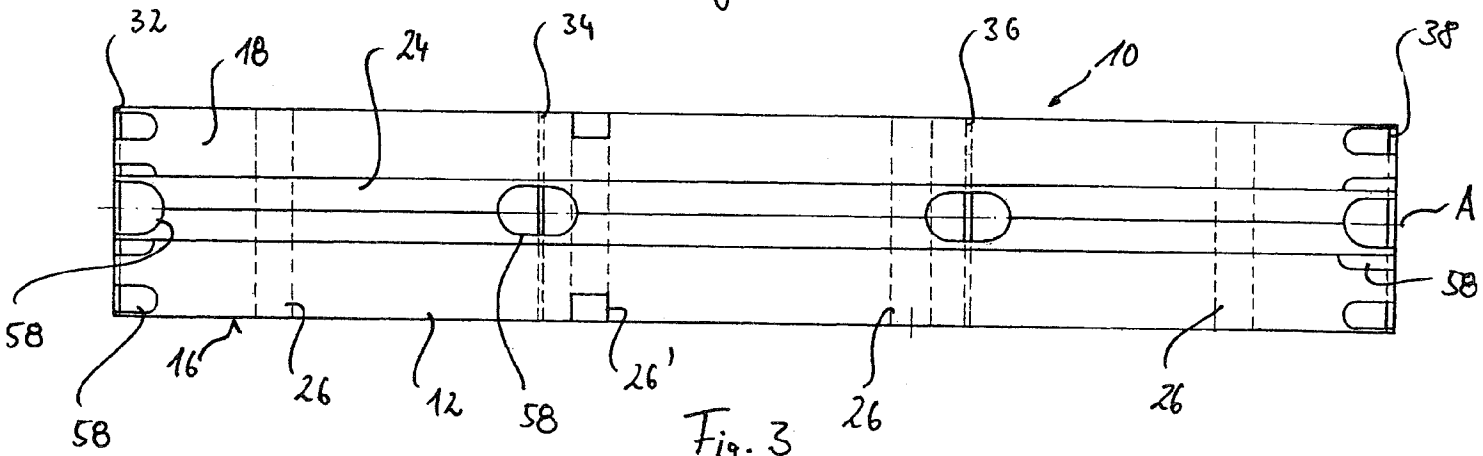
FIG. 3 shows a top view of the vehicle restraining system according to the invention.

FIGS. 2 and 3 furthermore show that single transversal skids 26 can also function as water drains. In order to permit a waterflow transversally through the wall element 12, for example the outer skin is interrupted in the region of the transversal skid 26' as shown in FIGS. 2 and 3.

Finally, it is to be pointed to the fact that the outer skin is provided with engaging openings 58 which are helpful in order to facilitate the manufacturing, in particular in order to facilitate providing welding seams 40 and 42, but also in order to facilitate the assembly, for example for mounting connecting screws 48.

When assembling the vehicle restraining system according to the invention, preferably a plurality of wall elements is preassembled to a wall element assembly group, for example having a length of 12 meters. These preassembled groups are then mounted to one another at the construction site, which is facilitated by means of the wedge arrangement 60 and the angle arrangement 80. Then only the insertion pieces at the ends must be screwed to one another.

Thus, according to the invention one receives a vehicle restraining system 10, which can be easily assembled and which is nevertheless robust. In regard to possible collision situations the vehicle restraining system according to the invention has the following benefits. If a heavy vehicle collides/impacts, in particular with a large collision/impact angle, there is no risk that such a vehicle gets stuck with single components (post elements) of the vehicle restraining system. The closed outer skin rather provides that these heavy vehicles are redirected to the demanded degree. Moreover, the deformation capability of the vehicle restraining system according to the invention provides a sufficient reduction of the collision energy. In case of a collision of a lighter vehicle (for example up to 1000 kg), it may further happen that the vehicle ascends up the vehicle restraining system 10 according to the invention due to the ramp effect of the tapering portions 18 and 20. However, the vehicle impinges during ascending onto the projection 30. Thereby, the ascending movement is blocked and a further ascending is prevented or at least reduced. The vehicle is rather subject to a counter-impetus when impinging onto the projection 30 and is thereby redirected back onto of the roadway. According to the invention it is thereby possible to limit or completely prevent a strong ascending of the vehicle, which otherwise usually leads to an overturning of the vehicle.

The invention claimed is:

1. Vehicle restraining system for limiting roadways, having a base barrier running along a longitudinal axis, which rests on an underground and which tapers from the underground in the upward direction when viewed in a section orthogonal to the longitudinal axis, and having a guiding profile running along the longitudinal axis, which is arranged above the base barrier and connected thereto, wherein the base barrier and the guiding profile are connected to one another by means of a connecting region closed at least at one side, which connecting region extends from the upper end of the base barrier substantially in vertical direction upwardly to the guiding profile and runs along the longitudinal axis, whereby the base barrier, the connecting region and the guiding profile form a wall element, and wherein the guiding profile, when viewed in a section orthogonal to the longitudinal axis, projects in a horizontal direction past the connecting region towards the roadway characterized in that the wall element has an insertion piece adapted to the contour of the wall element at least at its longitudinal ends, which is inserted into the wall element, and wherein a plurality of transversal skids is associated to each wall element, which transversal skids extend transversally to the longitudinal axis and by means of which transversal skids the respective wall elements of the vehicle restraining system rest on the underground.

2. Vehicle restraining system according to claim 1, wherein the wall element, when viewed in a section orthogonal to the longitudinal axis, has a substantially continuous contour which is open to the underground.

3. Vehicle restraining system according to claim 1, wherein the wall element, when viewed in a section orthogonal to the longitudinal axis, is formed symmetrically with respect to a vertical axis extending substantially orthogonally with respect to the longitudinal axis and to the underground.

4. Vehicle restraining system according to claim 1, wherein the insertion piece is welded at least in sections to the inner surface of the wall element.

5. Vehicle restraining system according to claim 1, wherein stiffening ribs extending in the direction of the longitudinal axis are provided in the wall element.

6. Vehicle restraining system according to claim 1, wherein the vehicle restraining system is assembled wall element by wall element, wherein two adjacent wall elements can be coupled by connecting insertion pieces facing one another.

7. Vehicle restraining system according to claim 1, wherein the wall elements are resiliently screwed to one another by means of at least one screw connection.

8. Vehicle restraining system according to claim 7,
wherein the screw connection has a resilient plastic bushing or/and a Belleville washer package.

9. Vehicle restraining system according to claim 1,
wherein at least one angle arrangement is arranged on at least one insertion piece provided at the end of one of the wall elements, which angle arrangement, when assembling the vehicle restraining system, receives an insertion piece at the end of a further wall element in a positioning manner.

10. Vehicle restraining system according to claim 1,
wherein the angle arrangement has a ground plate and two supporting angles arranged in a distance to one another, wherein the distance (e) between two faces of the supporting angles facing to one another is larger than the double wall thickness of an insertion piece.

11. Vehicle restraining system according to claim 1,
wherein the transversal skids can be coupled with a friction cover and rest on the underground therewith.

12. Vehicle restraining system according to claim 1,
wherein the transversal skids are fixable to the underground, particularly by means of an elongated hole extending transversally with respect to the longitudinal axis.

13. Vehicle restraining system according to claim 1,
wherein each of the wall elements engagement openings facilitating the assembly are provided.

14. Vehicle restraining system according to claim 1,
wherein the wall element is composed of sheet portions, which are preferably edge bended.

15. Vehicle restraining system according to claim 1,
wherein the width of the guiding profile, when viewed in a section orthogonal to the longitudinal axis, is larger than 1.3 times the width of the connecting region.

16. Vehicle restraining system for limiting roadways, having a base barrier running along a longitudinal axis, which rests on an underground and which tapers from the underground in the upward direction when viewed in a section orthogonal to the longitudinal axis, and having a guiding profile running along the longitudinal axis, which is arranged above the base barrier and connected thereto, wherein the base barrier and the guiding profile are connected to one another by means of a connecting region closed at least at one side, which connecting region extends from the upper end of the base barrier substantially in vertical direction upwardly to the guiding profile and runs along the longitudinal axis, whereby the base barrier, the connecting region and the guiding profile form a wall element, and wherein the guiding profile, when viewed in a section orthogonal to the longitudinal axis, projects in a horizontal direction past the connecting region towards the roadway characterized in that the wall element has an insertion piece adapted to the contour of the wall element at least at its longitudinal ends, which is inserted into the wall element, and wherein a positioning wedge arrangement is mounted to at least one insertion piece arranged at the end of one of the wall elements, the positioning wedge of which interacts during the assembly of the vehicle restraining system with a corresponding wedge opening provided in an insertion piece at the end of a further wall element in a positioning manner.

17. Vehicle restraining system according to claim 16,
wherein the positioning wedge extends in the direction of the longitudinal axis and is faced with its one frontal surface to the insertion piece, and is provided at its opposite frontal surface with a holding plate extending substantially orthogonally with respect to the longitudinal axis.

* * * * *